US006959805B2

(12) United States Patent
Wendt et al.

(10) Patent No.: US 6,959,805 B2
(45) Date of Patent: Nov. 1, 2005

(54) DEVICE FOR DRIVING MATERIAL TO BE ROLLED ON VERTICAL ROLLING MILL CAGES

(75) Inventors: Stefan Wendt, Hilchenbach (DE); Achim Klein, Kreuztal-Kredenbach (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/491,934

(22) PCT Filed: Sep. 26, 2002

(86) PCT No.: PCT/EP02/10776

§ 371 (c)(1),
(2), (4) Date: Apr. 6, 2004

(87) PCT Pub. No.: WO03/033184

PCT Pub. Date: Apr. 24, 2003

(65) Prior Publication Data

US 2004/0244456 A1 Dec. 9, 2004

(30) Foreign Application Priority Data

Oct. 11, 2001 (DE) ..... 101 50 146

(51) Int. Cl.[7] ..... B65G 15/00
(52) U.S. Cl. ..... 198/836.3; 72/199
(58) Field of Search ..... 198/608, 626.5, 198/836.1, 836.2, 836.3, 836.4; 72/199, 210, 225, 242.2, 251

(56) References Cited

U.S. PATENT DOCUMENTS 4,803,862 A * 2/1989 Schulze et al. ..... 72/199
4,813,257 A * 3/1989 Feldmann et al. ..... 72/199
4,841,761 A * 6/1989 Stoy et al. ..... 72/238
6,098,791 A * 8/2000 Minnerop ..... 198/836.3
6,237,387 B1 * 5/2001 Yoshizawa et al. ..... 72/251
6,523,823 B1 * 2/2003 Bakoledis ..... 198/836.3
6,609,611 B1 * 8/2003 Lenhardt ..... 198/836.3

FOREIGN PATENT DOCUMENTS

| | | |
|---|---|---|
| DE | 942 389 | 5/1956 |
| FR | 849 968 | 12/1939 |
| JP | 04333304 | 11/1992 |
| JP | 58157516 | 9/1993 |
| JP | 07047417 | 2/1995 |

* cited by examiner

*Primary Examiner*—James R. Bidwell
(74) *Attorney, Agent, or Firm*—Herbert Dubno

(57) ABSTRACT

A guide device on a vertical roll rolling mill frame (WG) which has vertical guide plates (FP) for the rolled product on both sides of the vertical roll pair (VW) above the rollers (RR) of the roller conveyor for feeding the rolled product 2 and removing the rolled product from the roll and on a carrier (TR) for each vertical guide plate (FP), shiftable transversely to the rolling direction, adjustable and lockable. The carrier (TR) of each guide plate (FP) is connected on its back side with the linear positioning member of a mechanically or hydraulically driven shifting device which is fixed on the bearing body (LK) of the vertical roll. The carrier (TR) is cantilevered slidably above the roller conveyer and parallel to its roller axed in a cantilevered kulisse (FK) which is fixedly connected with the rolling mill frame.

5 Claims, 4 Drawing Sheets

DEVICE FOR DRIVING MATERIAL TO BE ROLLED ON VERTICAL ROLLING MILL CAGES

CROSS REFERENCE TO RELATED APPLICATIONS

This application is a national stage of PCT/EP02/10776 filed 26 Sep. 2002 and based upon German national application 101 50 146.3 filed 11 Oct. 2001 under the International Convention.

FIELD OF THE INVENTION

The invention relates to a guide device for rolled products on vertical-roll rolling mill stands with vertical guide plates for the rolled product on both sides of the vertical roll pair and which is shiftable transverse to the rolling direction on adjustable and lockable carriers above the rollers of rolling conveyors serving to feed the rolled products and to carry them away.

BACKGROUND OF THE INVENTION

Devices of this type are known in many embodiments and are disposed along the roller conveyors above the roller conveyor plane opposite one another and can be moved toward and away from one another on linearly shiftable bodies. As a rule these are independent or mounted on support frames connected with the roller stand for displacement thereon (see Japanese Patent Document JP 58157516 and JP 3433304). The shifting is effected by means of control arrangements with the aid of electrically or hydraulically operating drives (JP 8066710).

The guide devices with independent carriers form an arrangement with a more or less large spacing upstream and downstream from the respective mill stand because of the spatial requirements. In the case of a vertical roll stand they require special controls which determine the respective positions of the guide devices to match the positions of the vertical rolls of this mill stand.

OBJECT OF THE INVENTION

The invention has as its object to provide a guide device which avoids the need for such spacings and the necessity for a continuous matching of the positions of the vertical rolls and the guide elements to one another.

SUMMARY OF THE INVENTION

Starting from the known configuration of the guide device for the rolling of the rolled strip (JP 4333304) in which the strip edges are laterally supported and laterally limited as to their movements by guide elements connected with the bearing structures for the vertical rolls, this object is attained in that the carrier of each guide plate is connected at its back side with the linear positioning element or member of a mechanically or hydraulically driven shifting device which is mounted fixedly on the bearing body of the vertical roll, whereby the carrier is guided and supported in a guide kulisse (coulisse or groove) above the roller conveyor and rigid with the mill stand and cantilevered thereon for movement parallel to its rollers. The carriers of the guide plates can thus, as the invention further provides, be configured as vertically upstanding webs and flanges which taper in the shifting direction and on whose upper flange centrally a support disk is erected which extends into the guide kulisse and is provided on its upper edge with the member which slides in the guide kulisse coulisse and is supported thereby.

According to the invention, the shifting device is comprised of a threaded sleeve which is disposed fixed on the support body connected with the bearing body of the respective vertical roll and in which a headed spindle is received whose head end is connected with the carrier of the guide plate so that it can rotate while its other end is provided with a polygonal formation for receiving a positioning element such as a wrench or key.

This configuration of the guide device enables the rolling of the rolled products with square or rectangular or other profiled or structural shape cross section as well as heavy rolled products like ingots or slabs to be directly fed to the rolling gap of the vertical rolls, whereby the two guide plates with their respective carriers follow the adjustment movements of the respective vertical roll and enable guidance of the workpieces both ahead of and behind the rolls even in the case of reversing operation of the mill without other devices.

BRIEF DESCRIPTION OF THE DRAWING

The invention is described in greater detail in connection with the embodiment shown in the drawing.

In the drawing are seen.

SPECIFIC DESCRIPTION

Figure 1:
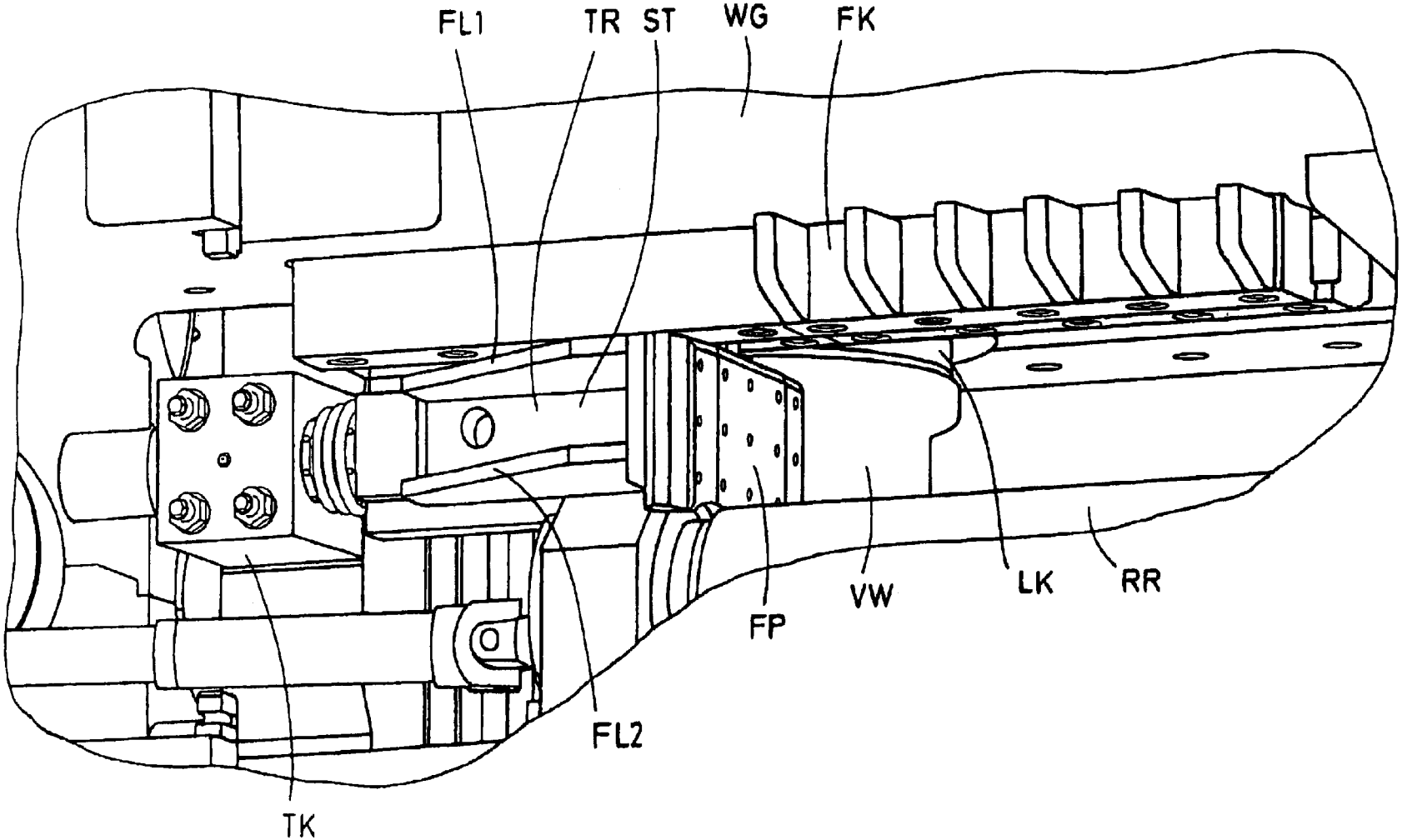
FIG. 1 the guide device as seen from below in a perspective illustration
Figure 2:
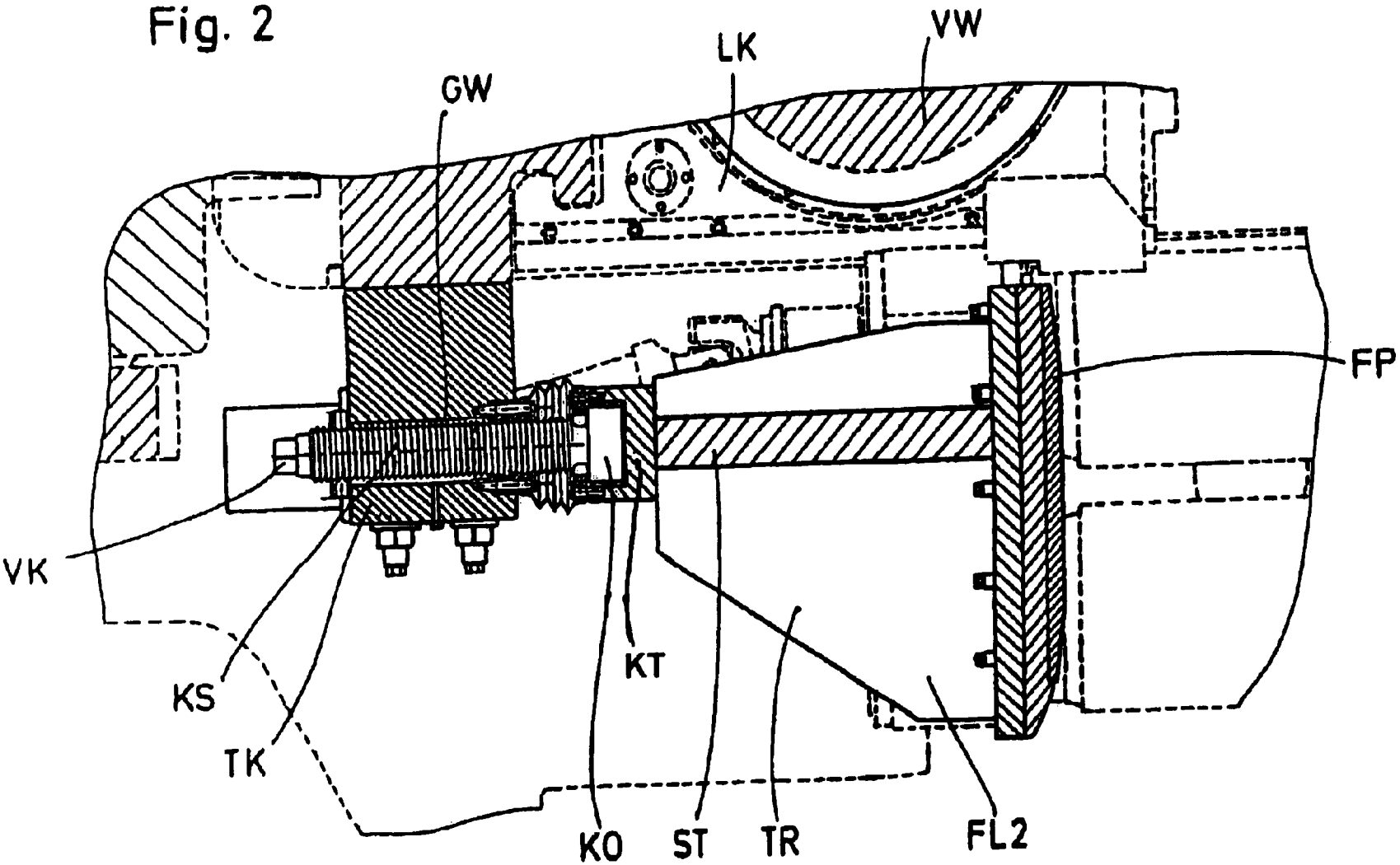
FIG. 2 the guide device as seen from above partly in a longitudinal section
Figure 3:
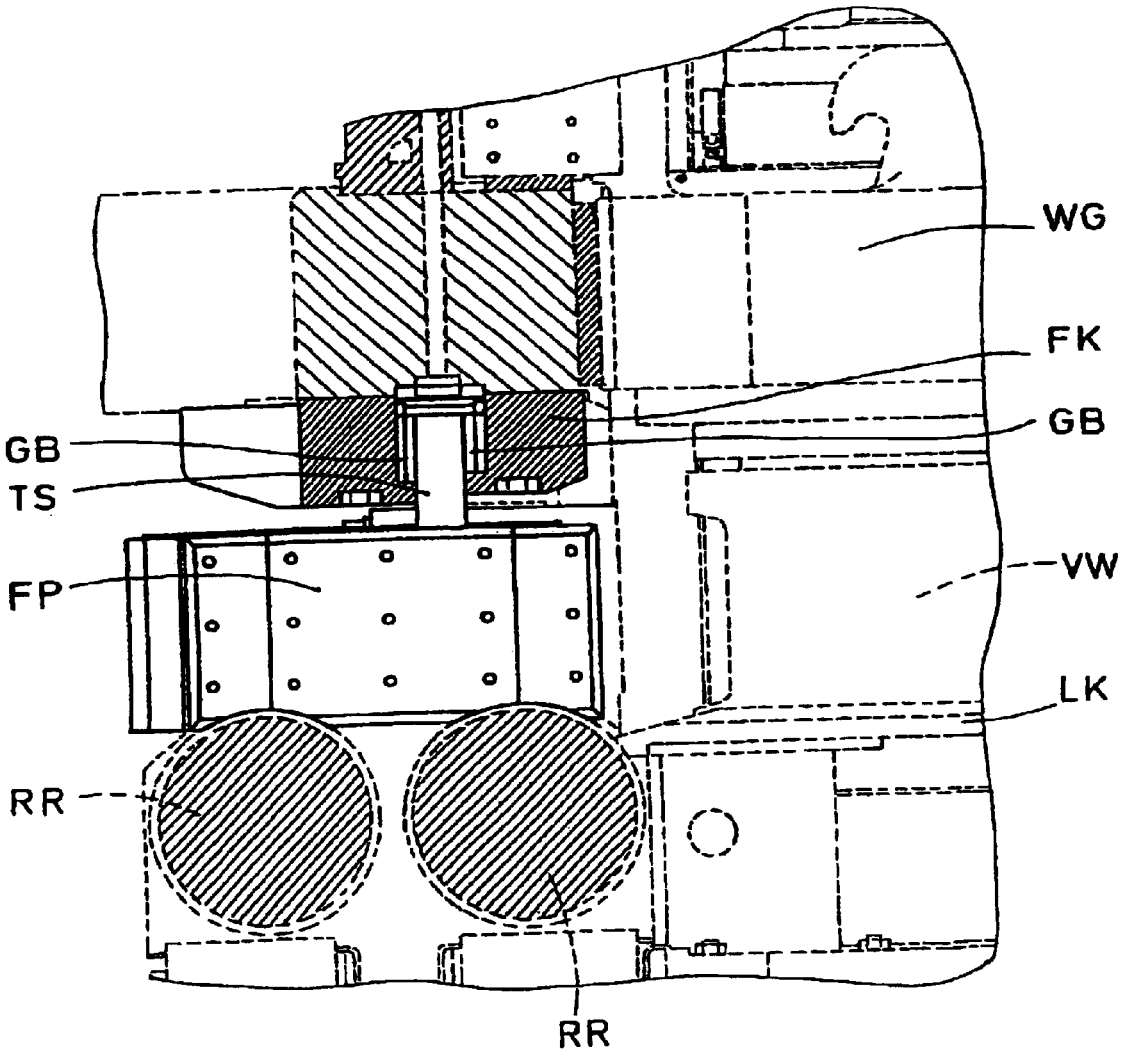
FIG. 3 a front view of the guide device partly in a vertical section.
Figure 4:
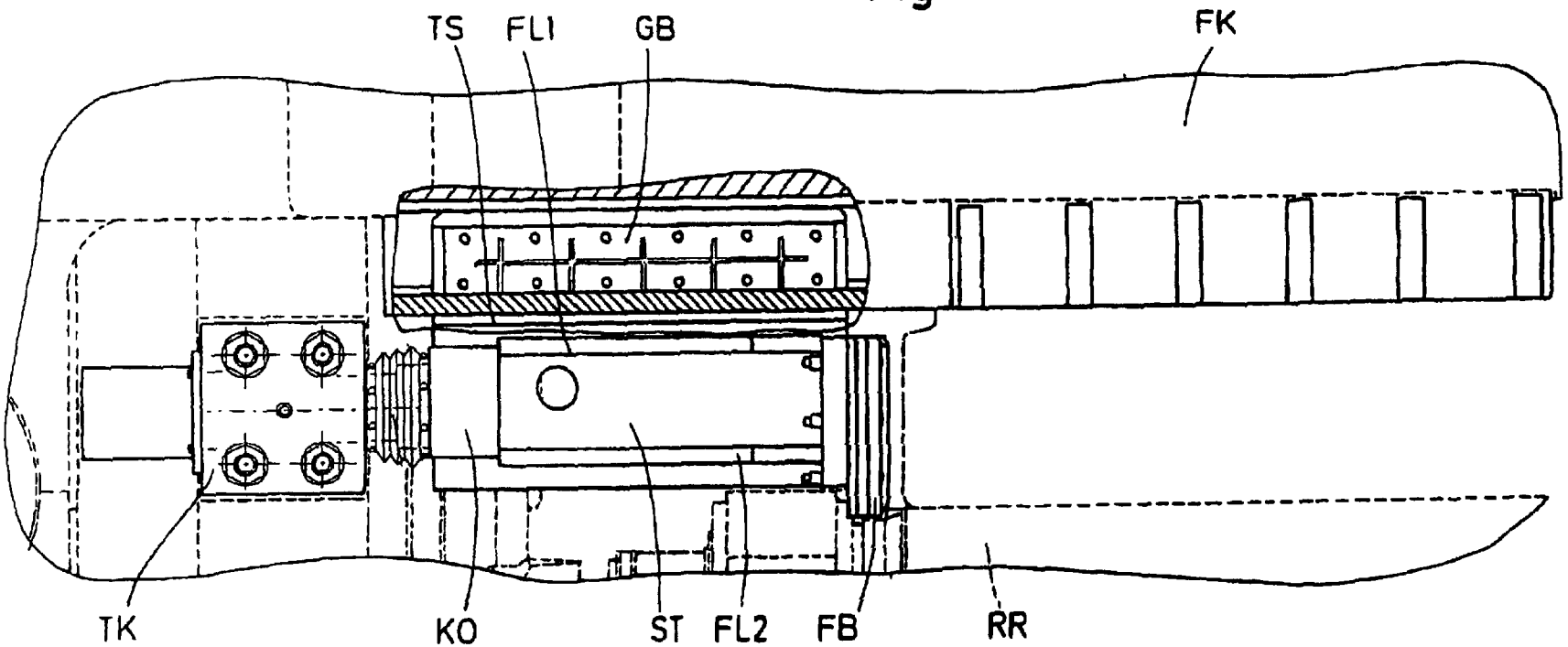
FIG. 4 a side view of the guide device partially in section.

As can be seen from FIG. 1, the support TR of the guide plate FP is comprised of a T-section with a vertical upstanding web ST and flanges FL1 and FL2 which taper away from the guide plate. On the upper flange FL1 (FIGS. 3 and 4) stands a support disk TS whose free lateral upper edge, provided with slide blocks GB, is guided in a horizontally extending guide coulisse or groove FK and is suspended therefrom. This guide coulisse or groove FK (compare FIG. 3) is fixedly connected with the mill stand WG and is cantilevered above the roller conveyor rollers RR as will appear further from FIG. 2, a threaded sleeve GW is connected with the bearing body LK of the vertical roll by a support body TK capable of adjustment in the threaded sleeve GW, a headed spindle KS is guided and has a head KO received in a coupling cup KT which is fixed to the carrier TR of the guide plate FP. The end of the headed spindle KS opposite the head KO here has a four-sided member VK which serves for engagement of an adjusting key (not shown).

For rolling operation, the guide plates FP associated with the two vertical rolls VW, are set into position with the aid of a positioning key with a spacing corresponding to the width of the rolled product to be rolled and guide the latter upon their entry into the rolling gap and then subsequently on their further travel any required positioning changes of the roll gap during the travel of the rolled product are followed by the two guide plates FP automatically since their supports TK are fixed to the bearing body LK of the respective vertical roll VW.

What is claimed is:

1. A guide device for a vertical-roll rolling mill having a roller conveyor, a pair of vertical rolls above said roller conveyor for rolling a product fed in a rolling direction through the rolling mill on said roller conveyor, and a respective bearing body supporting each of said vertical rolls for rotation, said guide device comprising:

a respective vertical guide plate adjacent each of said rolls for guiding said product between said rolls;

an I-section carrier for each of said guide plates extending and shiftable in a direction transverse to said rolling direction and having a vertical web and upper and lower flanges tapering away from the respective guide plate to a rear portion of the respective carrier;

a respective support disk mounted on the upper flange of each of said carriers;

a respective guide groove extending in the direction transverse to the rolling direction and receiving the respective support disk; and support blocks between each support disk and the respective guide groove whereby each of said carriers is suspended on the respective guide groove by the slide blocks for movement in said direction transverse to said rolling direction.

2. The guide device defined in claim 1, further comprising a respective shifting device acting upon said rear portion of each of said carriers and coupling the respective carrier to a respective bearing body whereby each guide plate follows movement of the respective vertical roll in said direction transverse to the rolling direction.

3. The guide device defined in claim 2 wherein each of said shifting devices is comprised of a threaded sleeve fixed to a support body connected to the respective bearing body; and a headed spindle received in the respective threaded sleeve, each spindle having a head end connected with the rear portion of the respective carrier such that the respective head end can be rotated, another end of each spindle being configured with a polygonal formation upon which a setting element can be engaged.

4. A guide device for a vertical-roll rolling mill having a roller conveyor, a pair of vertical rolls above said roller conveyor for rolling a product fed in a rolling direction through the rolling mill on said roller conveyor, and a respective bearing body supporting each of said vertical rolls for rotation, said guide device comprising:

a respective vertical guide plate adjacent each of said rolls for guiding said product between said rolls;

a carrier for each of said guide plates extending and shiftable in a direction transverse to said rolling direction and having a rear portion;

a respective guide groove extending in the direction transverse to the rolling direction and receiving the respective support and supporting the respective carrier whereby each of said carriers is cantilevered on the respective guide groove by the slide blocks for movement in said direction transverse to said rolling direction; and a respective shifting device acting upon said rear portion of each of said carriers and coupling the respective carrier to a respective bearing body whereby each guide plate follows movement of the respective vertical roll in said direction transverse to the rolling direction.

5. A guide device for a vertical-roll rolling mill having a roller conveyor, a pair of vertical rolls above said roller conveyor for rolling a product fed in a rolling direction through the rolling mill on said roller conveyor, and a respective bearing body supporting each of said vertical rolls for rotation, said guide device comprising:

a respective vertical guide plate adjacent each of said rolls for guiding said product between said rolls;

a carrier for each of said guide plates extending and shiftable in a direction transverse to said rolling direction and having a rear portion;

a respective guide groove extending in the direction transverse to the rolling direction and receiving the respective support and supporting the respective carrier whereby each of said carriers is cantilevered on the respective guide groove by the slide blocks for movement in said direction transverse to said rolling direction; and a respective shifting device acting upon said rear portion of each of said carriers and coupling the respective carrier to a respective bearing body whereby each guide plate follows movement of the respective vertical roll in said direction transverse to the rolling direction, each of said shifting devices being comprised of a threaded sleeve fixed to a support body connected to the respective bearing body; and a headed spindle received in the respective threaded sleeve, each spindle having a head end connected with the rear portion of the respective carrier such that the respective head end can be rotated, another end of each spindle being configured with a polygonal formation upon which a setting element can be engaged.

* * * * *